US010724219B2

(12) United States Patent
Huitron

(10) Patent No.: US 10,724,219 B2
(45) Date of Patent: Jul. 28, 2020

(54) AUTOMATIC TOILET BOWL CLEANING APPARATUS AND METHODS

(71) Applicant: Beatris Huitron, Modesto, CA (US)

(72) Inventor: Beatris Huitron, Modesto, CA (US)

( * ) Notice: Subject to any disclaimer, the term of this patent is extended or adjusted under 35 U.S.C. 154(b) by 0 days.

(21) Appl. No.: 16/215,518

(22) Filed: Dec. 10, 2018

(65) Prior Publication Data

US 2020/0181898 A1 Jun. 11, 2020

(51) Int. Cl.
*E03D 9/00* (2006.01)

(52) U.S. Cl.
CPC ..... *E03D 9/005* (2013.01)

(58) Field of Classification Search
CPC .. E03D 9/032; E03D 9/03; E03D 9/02; E03D 9/002; E03D 9/005; A47K 13/02
USPC ..... 4/223, 233, 222; 222/333, 251; 134/169 R
See application file for complete search history.

(56) References Cited

U.S. PATENT DOCUMENTS 3,068,492 A * 12/1962 Price ..... B65D 83/267 4/222
3,178,070 A * 4/1965 Leland ..... E03D 9/005 222/180
4,154,375 A * 5/1979 Bippus ..... H01H 3/0206 200/61.86
4,625,342 A * 12/1986 Gangnath ..... E03D 9/007 222/163
4,670,916 A * 6/1987 Bloom ..... E03D 9/007 222/402.15
5,367,716 A * 11/1994 Huang ..... E03D 9/031 4/222
5,377,363 A * 1/1995 Shieh ..... A61L 9/12 4/222
5,727,262 A * 3/1998 Littlejohn ..... E03D 9/052 4/213
5,806,105 A * 9/1998 Yu ..... A47K 13/302 4/233
5,862,532 A * 1/1999 Cain ..... E03D 9/007 4/222
5,958,334 A * 9/1999 Haddon ..... E03D 9/02 422/5
6,000,067 A * 12/1999 Cascia ..... E03D 9/02 4/222

(Continued)

OTHER PUBLICATIONS

Davison, Cleantoi search results, 2017, Pittsburgh, PA.

*Primary Examiner* — Benjamin R Shaw
(74) *Attorney, Agent, or Firm* — Cionca IP Law P.C.; Marin Cionca

(57) ABSTRACT

A toilet bowl cleaning apparatus comprising: a housing; a cleaning solution compartment having: a reservoir configured to hold liquid; a valve associated with the reservoir; a pump compartment having: a reservoir tube extending out from the valve; a pump connected to the reservoir tube, the pump being configured to dispense the liquid held in the reservoir via the reservoir tube; and a pump tube extending from the pump and out of the housing; wherein the pump is further configured to dispense the liquid through the pump tube; toilet bowl tubes connected to the pump tube via a splitter, such that the liquid is further dispensed from the pump tube to each toilet bowl tube and is sprayed out of the toilet bowl tubes and into the toilet bowl; and an actuator button, wherein a power source is configured to power the pump when the actuator button is engaged.

20 Claims, 5 Drawing Sheets

(56) References Cited

U.S. PATENT DOCUMENTS 6,049,918 A 4/2000 White, Sr.
6,192,524 B1 2/2001 Black
6,431,400 B1 * 8/2002 O'Maley ..... B67D 7/344 141/367
6,622,315 B1 * 9/2003 Feygin ..... A47K 13/30 4/223
6,772,450 B1 * 8/2004 Saylor ..... E03D 9/005 4/222
6,883,189 B2 4/2005 Pierce
7,269,863 B1 9/2007 Blevins
7,316,038 B2 * 1/2008 Egeresi ..... A47K 13/30 4/223
8,136,171 B2 3/2012 Huang
8,776,278 B1 * 7/2014 Dorra ..... A47K 13/302 4/233
9,534,366 B2 1/2017 Medina
9,644,358 B2 5/2017 Qualls et al.
9,850,645 B2 12/2017 Coulter et al.
2007/0136937 A1 * 6/2007 Sawalski ..... B65D 83/759 4/223
2007/0204387 A1 * 9/2007 Cornelius ..... A01M 1/2044 4/223
2007/0240252 A1 * 10/2007 Leonard ..... E03D 9/032 4/223
2008/0017762 A1 * 1/2008 Leonard ..... E03D 9/032 248/79
2009/0133185 A1 * 5/2009 Fisseha ..... A47K 13/30 4/233
2009/0249533 A1 * 10/2009 Sawalski ..... E03D 9/005 4/223
2010/0031982 A1 * 2/2010 Hornsby ..... E03D 9/005 134/169 R
2010/0205729 A1 * 8/2010 Muhlhausen ..... E03D 9/005 4/223
2011/0004986 A1 * 1/2011 Vu ..... E03D 9/007 4/223
2011/0088153 A1 * 4/2011 Richard ..... E03D 9/03 4/223
2011/0088154 A1 * 4/2011 Richard ..... E03D 9/005 4/223
2011/0302705 A1 * 12/2011 Frey ..... E03D 9/005 4/223
2012/0131738 A1 * 5/2012 Abbondanzio ..... E03D 9/005 4/223
2012/0144569 A1 * 6/2012 Kodat ..... A47K 13/302 4/222
2012/0174304 A1 * 7/2012 Abbondanzio ..... E03D 9/005 4/223
2012/0266920 A1 * 10/2012 Burt ..... E03D 9/005 134/24
2013/0025038 A1 * 1/2013 Frey ..... B05B 17/0607 4/222
2015/0101113 A1 * 4/2015 Lee ..... E03D 9/005 4/223
2018/0087254 A1 * 3/2018 Lloyd ..... E03D 9/005
2018/0223517 A1 * 8/2018 Wood ..... F21V 23/04

* cited by examiner

AUTOMATIC TOILET BOWL CLEANING APPARATUS AND METHODS

BACKGROUND OF INVENTION

1. Field of the Invention

The invention relates generally to toilet bowl cleaning devices and more specifically to automated, brushless toilet bowl cleaning devices.

2. Description of the Related Art

Cleaning toilets can be a very unpleasant process. When a person is cleaning a toilet, they may be faced with many unpleasantries including, but not limited to, bad smell, putting their face close to the toilet bowl, risk of touch a dirty toilet bowl, and/or the risk of splashing toilet bowl water onto the skin. The chore of cleaning the toilet can also be time consuming, or may also be difficult for a person with physical disabilities. Thus, there is a need for an improved method and/or device that eliminates such unpleasantries while accomplishing a necessary task.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect, an automatic toilet bowl cleaning apparatus ("automated toilet bowl cleaner," "automatic toilet bowl cleaner," or "automatic toilet cleaner") is provided, having a plurality of compartments including, but not limited to, a cleaning solution compartment, an air freshener compartment, a battery compartment, and a pump compartment. As an example, the cleaning solution compartment may have a cleaning solution reservoir to store a large quantity of cleaning solution for later use. An air freshener compartment may hold an air freshener to eliminate unpleasant toilet odors during cleaning or regular use. A battery compartment may provide power to a pump, and thus may also power the automatic toilet cleaner. As an example, standard batteries such as DD batteries may be used to power the automatic toilet cleaner. As another example, the automatic toilet cleaner may be provided with an electric plug (not shown) such that the automatic toilet cleaner may be plugged into a standard outlet for power. A pump compartment may be provided with a pump, wherein the pump injects the cleaning solution from the cleaning solution compartment into a toilet bowl via flexible tubes. As an example, the pump may be activated by an actuator switch located at the top end of the automatic toilet cleaner. The automatic toilet cleaner may be operated by pressing the actuator button to inject cleaning solution at high pressure into a toilet bowl.

Thus, an advantage may be that the need for brushing the residue and grime in a toilet bowl may be eliminated for a user. Another advantage may be that other unpleasantries associated with cleaning a toilet bowl, as well as the amount of time required to clean the toilet bowl, may be reduced for the user. Another advantage may be that a person having mobility issues or problems with reaching downwards may more easily clean their toilet bowl. Another advantage may be that the automatic toilet cleaner may be simple and easy for the user to install onto a toilet. Another advantage may be that the cleaning solution may be stored inside of a cartridge that may be refillable, and thus may reduce waste.

In another aspect, a toilet bowl cleaning apparatus for cleaning a toilet bowl of a toilet is provided, the toilet bowl cleaning apparatus comprising: a housing having: a top end; a bottom end; a left side; a right side; a front surface; and a rear surface; a battery compartment within the housing, the battery compartment being configured to house at least one battery; a cleaning solution compartment within the housing, the cleaning solution compartment having: a cleaning solution reservoir configured to hold liquid; a valve associated with the cleaning solution reservoir; a pump compartment within the housing, the pump compartment having: a reservoir tube extending out from the valve; a pump connected to the reservoir tube, the pump being configured to dispense the liquid held in the cleaning solution reservoir via the reservoir tube; and a pump tube extending from the pump and out of the housing; wherein the pump is further configured to dispense the liquid through the pump tube; a plurality of toilet bowl tubes; a splitter; wherein the plurality of toilet bowl tubes is connected to the pump tube via the splitter, such that the liquid is further dispensed from the pump tube to each toilet bowl tube of the plurality of toilet bowl tubes and is sprayed out of the plurality of toilet bowl tubes and into the toilet bowl; a plurality of clamps, each clamp of the plurality of clamps being configured to attach a toilet bowl tube of the plurality of toilet bowl tubes to the toilet bowl; an air freshener compartment at the front surface of the housing, the air freshener compartment being configured to contain an air freshener cartridge; and a plurality of interior walls within the housing, the plurality of interior walls separating the battery compartment, the cleaning solution compartment, the pump compartment, and the air freshener compartment, and wherein the valve extends through an interior wall of the plurality of interior walls separating the cleaning solution compartment and the pump compartment; a battery compartment lid at the top end; a cleaning solution compartment lid at the top end; a hinge between the battery compartment lid and the cleaning solution compartment lid; a plurality of air freshener vents on the front surface of the housing configured to allow air to pass from the air freshener compartment out of the housing; an actuator button, wherein the at least one battery is configured to power the pump when the actuator button is engaged; a plurality of mounting holes on the rear surface; and a plurality of hangers, wherein the plurality of mounting holes is configured to be associated with the plurality of hangers, such that the toilet bowl cleaning apparatus can be hung from a surface. Thus, again, an advantage may be that the need for brushing the residue and grime in a toilet bowl may be eliminated for a user. Another advantage may be that other unpleasantries associated with cleaning a toilet bowl, as well as the amount of time required to clean the toilet bowl, may be reduced for the user. Another advantage may be that a person having mobility issues or problems with reaching downwards may more easily clean their toilet bowl. Another advantage may be that the automatic toilet cleaner may be simple and easy for the user to install onto a toilet. Another advantage may be that the cleaning solution may be stored inside of a cartridge that may be refillable, and thus may reduce waste.

In another aspect, a toilet bowl cleaning apparatus for cleaning a toilet bowl of a toilet is provided, the toilet bowl cleaning apparatus comprising: a housing having: a top end; a bottom end; a left side; a right side; a front surface; and a rear surface; a cleaning solution compartment within the housing, the cleaning solution compartment having: a cleaning solution reservoir configured to hold liquid; a valve associated with the cleaning solution reservoir; a pump compartment within the housing, the pump compartment having: a reservoir tube extending out from the valve; a pump connected to the reservoir tube, the pump being configured to dispense the liquid held in the cleaning solution reservoir via the reservoir tube; and a pump tube extending from the pump and out of the housing; wherein the pump is further configured to dispense the liquid through the pump tube; a plurality of toilet bowl tubes; a splitter; wherein the plurality of toilet bowl tubes is connected to the pump tube via the splitter, such that the liquid is further dispensed from the pump tube to each toilet bowl tube of the plurality of toilet bowl tubes and is sprayed out of the plurality of toilet bowl tubes and into the toilet bowl; at least one interior wall within the housing, the at least one interior wall separating the cleaning solution compartment and the pump compartment, and wherein the valve extends through the at least one interior wall; a power source; and an actuator button, wherein the power source is configured to power the pump when the actuator button is engaged. Thus, again, an advantage may be that the need for brushing the residue and grime in a toilet bowl may be eliminated for a user. Another advantage may be that other unpleasantries associated with cleaning a toilet bowl, as well as the amount of time required to clean the toilet bowl, may be reduced for the user. Another advantage may be that a person having mobility issues or problems with reaching downwards may more easily clean their toilet bowl. Another advantage may be that the automatic toilet cleaner may be simple and easy for the user to install onto a toilet. Another advantage may be that the cleaning solution may be stored inside of a cartridge that may be refillable, and thus may reduce waste.

In another aspect, a method of installing and using a toilet bowl cleaning apparatus for cleaning a toilet bowl of a toilet is provided, the toilet bowl cleaning apparatus comprising: a housing having: a top end; a bottom end; a left side; a right side; a front surface; and a rear surface; a cleaning solution compartment within the housing, the cleaning solution compartment having: a cleaning solution reservoir configured to hold liquid; a valve associated with the cleaning solution reservoir; a pump compartment within the housing, the pump compartment having: a reservoir tube extending out from the valve; a pump connected to the reservoir tube, the pump being configured to dispense the liquid held in the cleaning solution reservoir via the reservoir tube; and a pump tube extending from the pump and out of the housing; wherein the pump is further configured to dispense the liquid through the pump tube; a plurality of toilet bowl tubes; a splitter; wherein the plurality of toilet bowl tubes is connected to the pump tube via the splitter, such that the liquid is further dispensed from the pump tube to each toilet bowl tube of the plurality of toilet bowl tubes and is sprayed out of the plurality of toilet bowl tubes and into the toilet bowl; a plurality of clamps, each clamp of the plurality of clamps being configured to attach a toilet bowl tube of the plurality of toilet bowl tubes to the toilet bowl; a plurality of interior walls within the housing, the plurality of interior walls separating the battery compartment, the cleaning solution compartment, the pump compartment, and the air freshener compartment, and wherein the valve extends through an interior wall of the plurality of interior walls separating the cleaning solution compartment and the pump compartment; a power source; an actuator button, wherein the power source is configured to power the pump when the actuator button is engaged; a plurality of mounting holes on the rear surface; and a plurality of hangers, wherein the plurality of mounting holes is configured to be associated with the plurality of hangers; the method comprising the steps of: inserting the plurality of hangers into the plurality of mounting holes; hanging the plurality of hangers on a top edge of a toilet tank of the toilet; securing each toilet bowl tube of the plurality of toilet bowl tubes to an outer rim of the toilet bowl using the plurality of clamps; and engaging the actuator button to spray the liquid into the toilet bowl. Thus, again, an advantage may be that the need for brushing the residue and grime in a toilet bowl may be eliminated for a user. Another advantage may be that other unpleasantries associated with cleaning a toilet bowl, as well as the amount of time required to clean the toilet bowl, may be reduced for the user. Another advantage may be that a person having mobility issues or problems with reaching downwards may more easily clean their toilet bowl. Another advantage may be that the automatic toilet cleaner may be simple and easy for the user to install onto a toilet. Another advantage may be that the cleaning solution may be stored inside of a cartridge that may be refillable, and thus may reduce waste.

The above aspects or examples and advantages, as well as other aspects or examples and advantages, will become apparent from the ensuing description and accompanying drawings.

BRIEF DESCRIPTION OF DRAWINGS

For exemplification purposes, and not for limitation purposes, aspects, embodiments or examples of the invention are illustrated in the figures of the accompanying drawings, in which.

DETAILED DESCRIPTION

Figure 1:
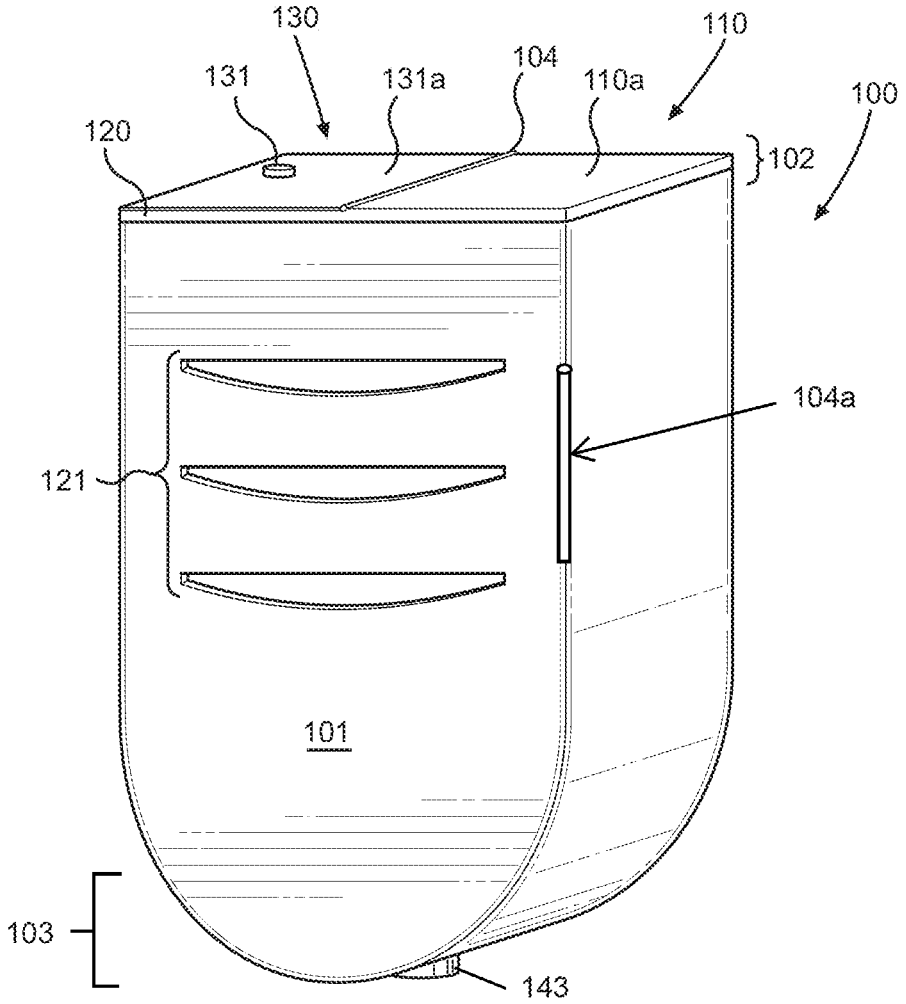
FIG. 1 illustrates the front perspective view of an automated toilet bowl cleaning apparatus, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 130 and 230, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

Figure 4:
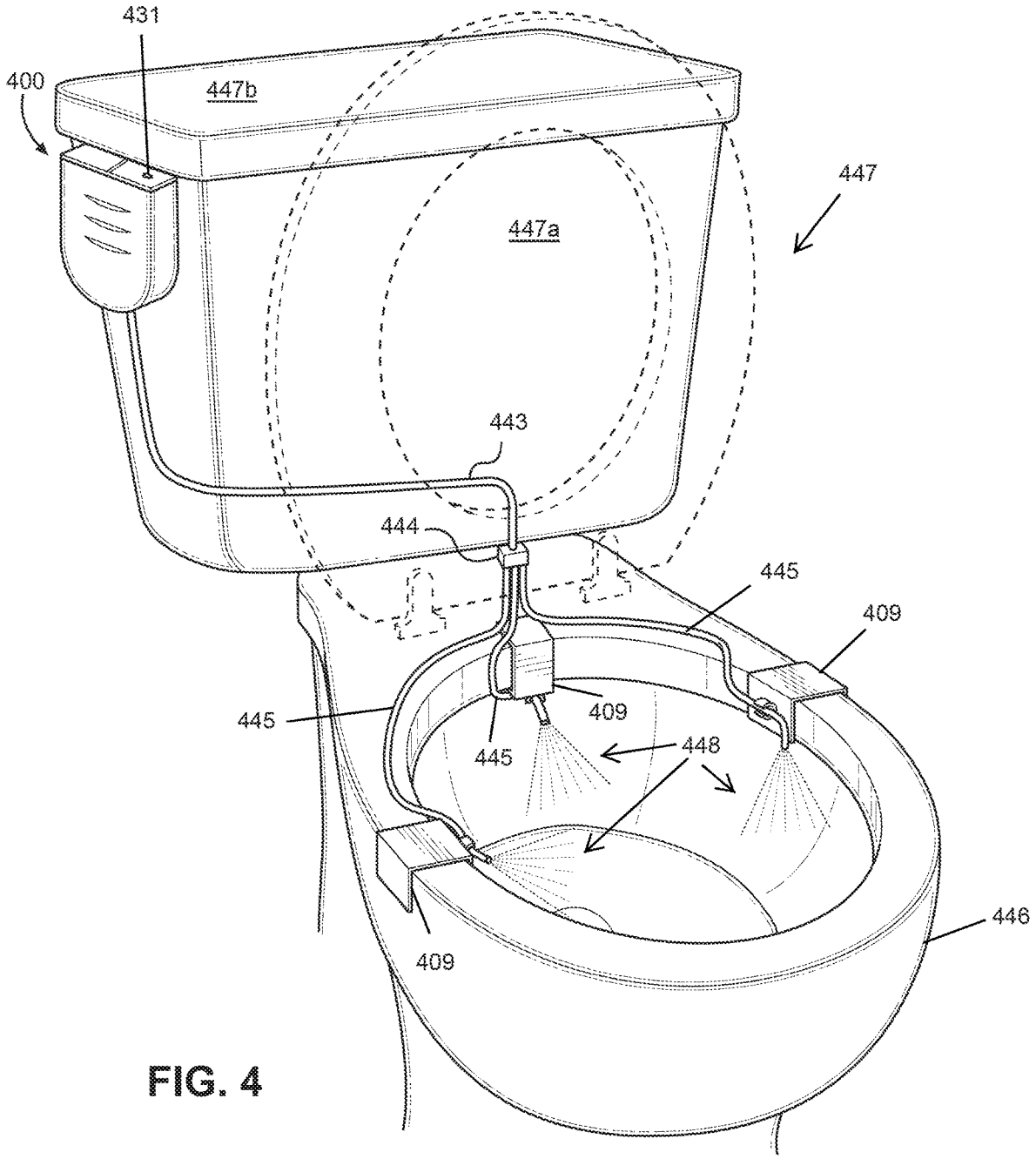
FIG. 4 illustrates the front perspective view of automatic toilet cleaner installed on a toilet, according to an aspect.

FIG. 1 illustrates the front perspective view of an automated toilet bowl cleaning apparatus ("automated toilet bowl cleaner," "automatic toilet bowl cleaner," "automatic toilet cleaner," or "cleaner") 100, according to an aspect. The top end 102 of the automatic toilet cleaner 100 may be flat and the bottom end 103 may be curved. The automatic toilet cleaner 100 may be mounted inside or outside of the tank of the toilet to be cleaned, for example (as shown in FIG. 4). It should be noted that the automatic toilet cleaner 100 may also be mounted in any other suitable locations as well. The automatic toilet bowl cleaner 100 may be provided with a plurality of compartments. As an example, the compartments may include a cleaning solution compartment 110, an air freshener compartment 120, a battery compartment 130, and a pump compartment (shown by 240 in FIG. 2). Air freshener vents 121 may be provided on the front surface ("front face," "front surface," or "front side") 101 of the automatic toilet cleaner 100, such that the scent of an air freshener cartridge (not shown) may waft through the vents 121. The air freshener may be inserted into the air freshener compartment 120 at the top end 102, for example.

On top of the battery compartment 130, the automatic toilet cleaner may be provided with an actuator button ("actuator button," "on/off button," or "actuation button") 131. As an example, the actuator button 131 may activate a pump to inject a cleaning solution into a toilet bowl, as is discussed in greater detail when referring to FIG. 2B. The actuator button 131 may be provided such that the pump is turned on while the button is being pressed, or, a single press of the button 131 may cause the pump to turn on and then shut off. At the bottom end 103 of the cleaner, a pump tube 143 may extend out of the cleaner. Cleaning solution (not shown) may be dispensed out of the pump tube 143 for cleaning the toilet. The cleaning solution may be dispensed out of the pump tube 143 and next through hoses or tubes to direct the flow of liquid into the toilet bowl, as will be described in further detail hereinafter.

It should be noted that the automatic toilet cleaner 100 may also be provided with an LED light (not shown) on top of the battery compartment 130 to indicate when the batteries (shown by 232 in FIGS. 2A-2B) are low and are in need of replacement. As an example, the provided LED light may blink red when the batteries are low.

Again, the automatic toilet cleaner 100 may be provided with an air freshener compartment 120. The air freshener compartment 120 may extend across the entire width of the cleaner 100. As an example, a user may place an air freshener cartridge (not shown) within the air freshener compartment, such that the scent of the air freshener cartridge may waft through vents 121. Once the scent of the air freshener cartridge has faded and the air freshener cartridge is in need of replacement, a user may easily replace the cartridge by opening the air freshener compartment 120. It should be noted that air fresheners other than air fresheners provided as cartridges may be used, and any suitable air freshener may be placed within the air freshener compartment 120.

As an example, a hinge 104 may be provided between the battery compartment 130 and the cleaning solution compartment 110, such that the left side of the top end 102 contains the battery compartment 130, and the right side of the top end 102 contains the cleaning solution compartment 110. The hinge 104 may allow for the two compartments to be opened independently of each other using the provided battery lid 131*a* and cleaning solution lid 110*a*. As another example, the top end 102 may be provided with a fully removable lid (which may, again, be provided as 130*a* and 110*a*). The removability of the lid may a user to replace batteries, refill a cleaning solution reservoir (shown by 211 of FIG. 2), replace an air freshener cartridge, or perform any other suitable maintenance. As another example, a second hinge 104*a* may be provided at the front surface of the cleaner 100, such that the air freshener compartment 120 can be opened from the front, by swinging the door open outwards. Thus, an advantage may be that the air freshener compartment 120 may be access independently of the other compartments.

Figure 2A:
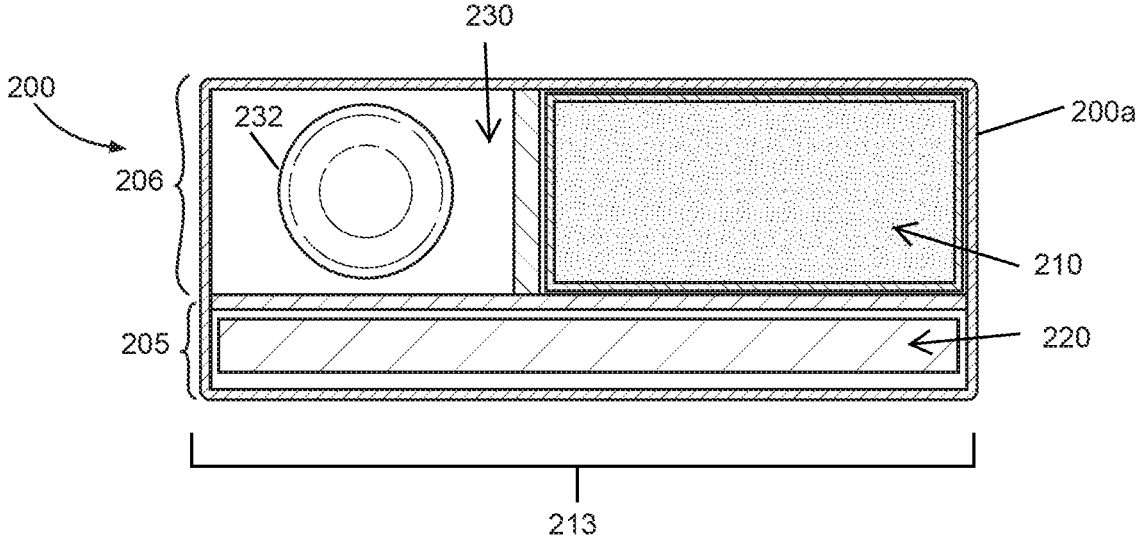
FIGS. 2A-2B illustrate the top sectional view and the front sectional view, respectively, of the automatic toilet cleaner, according to an aspect.
Figure 2B:
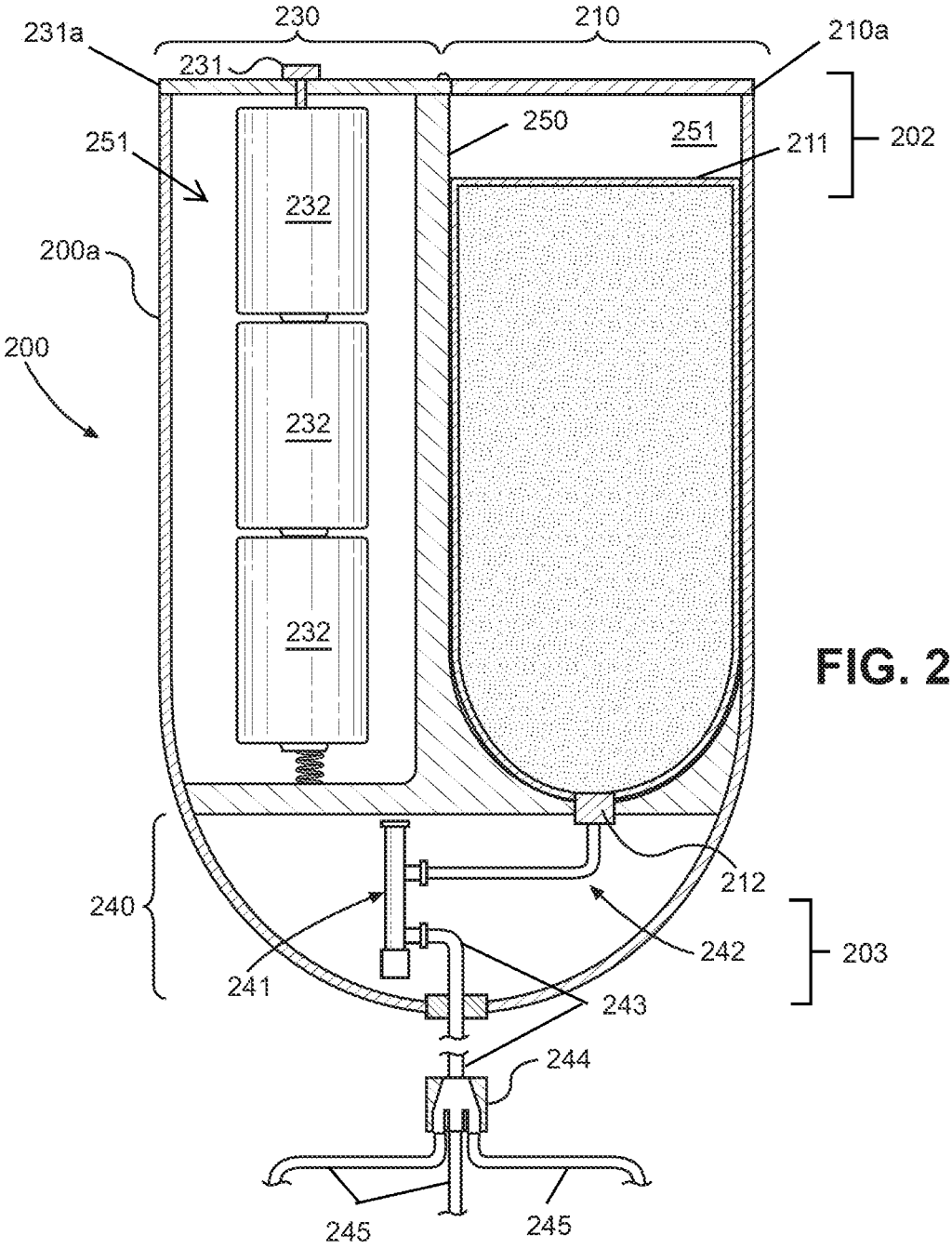

FIGS. 2A-2B illustrate the top sectional view and the front sectional view, respectively, of the automatic toilet cleaner 200, according to an aspect. In the top view shown by FIG. 2A, the automatic toilet cleaner 200 may have a substantially rectangular shape. As an example, the automatic toilet cleaner 200 may be provided with an air freshener compartment 220 at the front side ("front side," or "front end") 205. The air freshener compartment 220 may extend across the entire width 213 of the automatic toilet cleaner 200. Additionally, the rear side ("rear side," or "rear end") 206 of the automatic toilet cleaner 200 may include a battery compartment 230, which may be accessed via the battery lid 231*a*, and a cleaning solution compartment 210, which may be accessed via the cleaning solution lid 210*a*. The cleaning solution compartment 210 may be on the right side of the rear end 206 of the cleaner 200. The battery compartment 230 may be on the left of the rear side or rear end 206, and may be smaller than the cleaning solution compartment 210. As an example, the cleaning solution compartment 210 may be twice as wide as the battery compartment 230.

In the front view shown by FIG. 2B, the cleaning solution compartment 210, the battery compartment 230, and the pump compartment 240 may be visible, while the air freshener compartment (shown by 120 in FIG. 1) is not visible. The pump compartment 240 may be located at the bottom end 203 of the cleaner 200, underneath the battery compartment 230 and the cleaning solution compartment 210. The cleaning solution compartment 210 may have the same or similar shape as the outer housing ("outer housing" or "housing") 200*a* of the automatic toilet cleaner, for example, with a flat shape at the top end 202 and a curved shape at the bottom end 203. It should be noted that each compartment within the housing 200*a* may be separated by interior walls 250, forming a plurality of interior spaces 251 for each compartment. The cleaner 200 may be constructed such that each compartment within the housing 200*a* is separated from the other compartments. An advantage may be that liquid, such as the cleaning solution housed within the cleaning solution compartment 210, does not come into contact with the batteries 232 or any other electrical components of the cleaner 200.

The battery compartment 230 may be configured to hold a plurality of batteries 232, and the batteries 232 may be replaced when they run out of charge. As an example, there may be three batteries D batteries, as shown in FIG. 2B. However, it should be noted that the cleaner 200 may be constructed to operate by using alternate types and numbers of batteries. The batteries may be connected to the actuator button 231 at the top end of a battery compartment 230 and a pump at the bottom end. The batteries 232 may be used be used to power the pump 241, as discussed in greater detail hereinafter. It should also be understood that any other suitable power source may be used to power the pump. The batteries or other power source may be used to power the pump when the actuator button 231 is activated or engaged.

As an example, a cleaning solution compartment 210 may be located next to the battery compartment 230 and above the pump compartment 240. The cleaning solution compartment 210 may be provided with a cleaning solution reservoir or cartridge ("cleaning solution reservoir," "cleaning solution cartridge," "cartridge," or "reservoir") 211, wherein a user may fill the reservoir 211 with a toilet bowl cleaning solution (not shown).

The cleaning solution used with the automatic toilet cleaner 200 may be any suitable cleaning solution as known in the art, such as a solution having disinfecting properties. As an example, the cleaning solution reservoir 211 may be refilled by directly pouring in more cleaning solution when the reservoir 211 is empty or low. The cartridge or reservoir 211 itself may also be replaced with a new cartridge when the cleaning solution within has been depleted. Refilling the reservoir 211 or putting in a new reservoir or cartridge 211 may be performed by lifting the lid (shown by 110*a* in FIG. 1) at the top end of the cleaner 200. As another example, an empty reservoir 211 may be replaced by inserting a new, full reservoir 211 into the compartment 210. A cleaning solution valve ("cleaning solution valve," or "valve") 212 may be provided at the bottom end of the cleaning solution compartment 210. The valve 212 may connect to the reservoir 211 by any suitable means, such as, for example, by puncturing a hole in the bottom of the reservoir 211, or by connecting to a gate or second valve or similar opening in the bottom of the reservoir 211. This valve 212 may be connected to a pump 241 via a reservoir tube 242, as disclosed in greater detail hereinafter. The shape of the reservoir 211 may be curved at the bottom end 203 and flat on the top end 202, for example. This shape may be advantageous by allowing the cleaning solution within the reservoir 211 to more easily drain downwards and collect at the bottom end 203, at the location of the valve 212. Thus, the shape of the reservoir 211 may make efficient use of all of the cleaning solution within the reservoir 211 without wasting any of the cleaning solution. The interior space 251 of the cleaning solution compartment 210 created by the interior walls 250 may also catch any liquid should the reservoir 211 spill or leak, which may prevent liquid from reaching the electronic components of the cleaner 200.

Again, the pump compartment 240 may be located at the bottom end of the automatic toilet cleaner 200 for example. The interior space 251 of the pump compartment 240 may house the pump 241, the reservoir tube 242, and pump tube 243. As an example, the reservoir tube 242 may connect the reservoir 211 with the pump 241 via a valve ("valve" or "cleaning solution valve") 212. Then, the pump 241 may be connected to a pump tube 243. The pump tube 243 may extend out of the pump compartment 240 and the housing 200*a*. The pump 241 may be connected to the reservoir 211 via a reservoir tube 242 attached to a cleaning solution valve 212, and next inject the cleaning solution into the toilet bowl via the pump tube 243 Additionally, the pump 241 may be connected to a toilet bowl via a flexible pump tube 243 attached to a splitter 244. The splitter 244 may split the pump tube 243 into a plurality of flexible toilet bowl tubes ("flexible tubes," "toilet bowl tubes,") "lines," or "tubes," 245, such that the pump tube 243 is split into a plurality of additional toilet bowl tubes 245. The flexible tubes 245 may be constructed from vinyl plastic, or any other suitable material.

It should be noted that the flexible tubes 245 may be of a smaller diameter than the pump tube 243, such that cleaning solution is injected into a toilet bowl at high pressure when traveling from the larger pump tube 243 to the smaller flexible tubes 245, for example. The pump may also deliver the liquid at a high speed in order to inject the cleaning solution into the toilet bowl at high pressure. As an example, the automatic toilet cleaner 200 may be provided with three flexible tubes 245, which may be secured to the toilet bowl (as shown in FIG. 4) and spaced apart in order to spray the entire toilet bowl with cleaning solution. Other suitable numbers of flexible tubes 245 may be used as needed with the automatic toilet cleaner.

Figure 3:
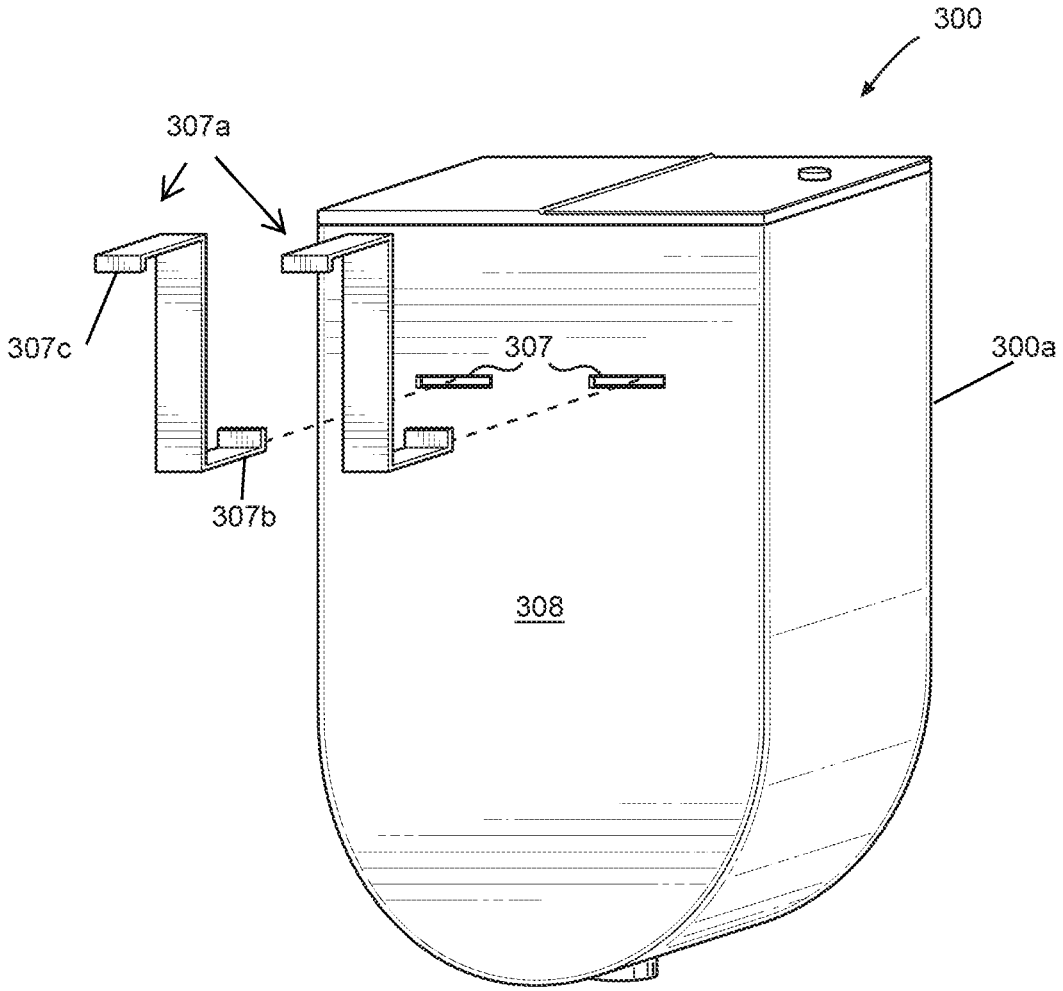
FIG. 3 illustrates the rear perspective view of the automatic toilet cleaner, according to an aspect.

FIG. 3 illustrates the rear perspective view of the automatic toilet cleaner 300, according to an aspect. The automatic toilet cleaner 300 may be provided with a plurality of mounting points ("mounting points," "mounting slots," or "mounting holes") 307 located on the rear face ("rear surface," "rear face," or "rear side") 308 of the automatic toilet cleaner 300. As an example, two mounting slots 307 may be provided, or any other suitable number. The automatic toilet cleaner 300 may also be provided with a hanger 307*a*. A hanger 307*a* may be associated with or inserted into each mounting slot 307, and may be used to hang the automatic toilet cleaner 300 inside or outside of the toilet tank via a top edge of the toilet tank, for example. Each hanger 307*a* may be substantially hook-shaped, or L-shaped. As another example, as is shown in FIG. 3, the hanger 307*a* may have two arms 307*b* extending outwards in opposite directions such that a first arm 307*b* may hook into a mounting slot 307, while a second arm 307*c* may hook onto the edge of a toilet tank. The hanger 307*a* may be associated with the mounting slots 307 via screws, or may be inserted into the mounting slots 307 and hold by friction-based contact, or by hooking onto the inside of the housing 300*a*, for example. The hangers 307*a* may allow for the automatic toilet cleaner 300 to be hung on the inside of the toilet tank, or on the outside of the toilet tank. As another example, suction cups may be associated with the mounting slots 307 to stick the automatic toilet cleaner 300 to the interior or exterior of the toilet tank. It should be understood that any other suitable method for attaching the automatic toilet cleaner 300 to the toilet may also be used.

FIG. 4 illustrates the front perspective view of automatic toilet cleaner 400 installed on a toilet 447, according to an aspect. As described when referring to FIG. 3, the automatic toilet cleaner 400 may hook onto a top edge of a toilet tank 447*a*, for example, using hangers (shown by 307*a* in FIG. 3, and not visible in FIG. 4). The automatic toilet cleaner may be installed by a user into the toilet tank 447*a*, which may be standard and known in the art. To install and use the automatic toilet cleaner 400 to clean a toilet bowl, the following exemplary process may be carried out. First, the hangers (shown by 307*a* in FIG. 3) are attached to the mounting slots (shown by 307 in FIG. 3) of the automatic toilet cleaner 400. Next, the lid 447*b* of the toilet tank is removed. Next, the hangers are hung from the top edge of the toilet tank 447*a*, and the automatic toilet cleaner 400 may be placed in the interior or the exterior of the toilet tank.

Next, the lid 447*b* of the toilet tank is replaced, which may secure the hangers in place. Next, to operate the automatic toilet cleaner, the actuator button 431 is pressed, which activates the pump (shown by 241 in FIG. 2A). If the cleaner 400 is installed in the interior of the toilet tank, the lid 447*b* of the toilet tank may first be removed in order to access the actuator button. The pump (shown by 241 in FIG. 2A) will pump cleaning solution from the reservoir (shown by 211 in FIG. 2A) into the toilet bowl 446 via the pump tube 443 and next the flexible tubes 445. Again, a splitter 444 may be used for allowing liquid flow from the pump tube 443 into a plurality of toilet bowl tubes 445. As an example, three toilet bowl tubes 443 may be provided. An advantage may be that the entire surface area of the inside of the toilet bowl 446 may be sprayed by the plurality of toilet bowl tubes 445 The actuator button 431 may be pressed for as long as needed by the user, until the toilet bowl 446 has been cleaned thoroughly by the high-pressure solution 448 sprayed into the toilet bowl 446. The cleaning solution 448 may be sprayed at a high enough pressure to remove grime and debris from the inside of the toilet bowl 446. Next, if the user chooses, the toilet can be flushed to ensure the cleaning solution cleans as much of the toilet bowl as possible, and to remove any debris that was sprayed off of the bowl 446. It should be understood that the pump tube 443 may be attached or associated with the toilet 447 in any suitable manner, such as by attaching the pump tube 443 underneath the toilet tank 447*b*. An advantage may be that this arrangement may provide a more discreet and thus desirable appearance for the user. It should also be understood that the pump tube 443 may be adjustable in length or provided in a variety of lengths in order to fit or accommodate different sizes or shapes of toilets.

The flexible tubes 445 may be secured to the rim of the toilet bowl by using clips ("clips," or "clamps") 409, for example. The clips 409 may be substantially C-shaped, as an example, or may have squared C-shape as shown in FIG. 4 as another example. Each flexible tube 445 may be secured to the toilet bowl by one clip 409 or a plurality of clips 409.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A toilet bowl cleaning apparatus for cleaning a toilet bowl of a toilet, the toilet bowl cleaning apparatus comprising:

a housing having:
- a top end;
- a bottom end;
- a left side;
- a right side;
- a front surface; and
- a rear surface;

a battery compartment within the housing, the battery compartment being configured to house at least one battery;

a cleaning solution compartment within the housing, the cleaning solution compartment having:

a cleaning solution reservoir configured to hold liquid;

a valve associated with the cleaning solution reservoir;

a pump compartment within the housing, the pump compartment having:

a reservoir tube extending out from the valve;

a pump connected to the reservoir tube, the pump being configured to dispense the liquid held in the cleaning solution reservoir via the reservoir tube; and a pump tube extending from the pump and out of the housing;

wherein the pump is further configured to dispense the liquid through the pump tube;

a plurality of toilet bowl tubes;

a splitter;

wherein the plurality of toilet bowl tubes is connected to the pump tube via the splitter, such that the liquid is further dispensed from the pump tube to each toilet bowl tube of the plurality of toilet bowl tubes and is sprayed out of the plurality of toilet bowl tubes and into the toilet bowl;

a plurality of clamps, each clamp of the plurality of clamps being configured to attach a toilet bowl tube of the plurality of toilet bowl tubes to the toilet bowl;

an air freshener compartment at the front surface of the housing, the air freshener compartment being configured to contain an air freshener cartridge; and a plurality of interior walls within the housing, the plurality of interior walls separating the battery compartment, the cleaning solution compartment, the pump compartment, and the air freshener compartment, and wherein the valve extends through an interior wall of the plurality of interior walls separating the cleaning solution compartment and the pump compartment;

a battery compartment lid at the top end;

a cleaning solution compartment lid at the top end;

a hinge between the battery compartment lid and the cleaning solution compartment lid;

a plurality of air freshener vents on the front surface of the housing configured to allow air to pass from the air freshener compartment out of the housing;

an actuator button, wherein the at least one battery is configured to power the pump when the actuator button is engaged;

a plurality of mounting holes on the rear surface; and a plurality of hangers, wherein the plurality of mounting holes is configured to be associated with the plurality of hangers, such that the toilet bowl cleaning apparatus can be hung from a surface.

2. The toilet bowl cleaning apparatus of claim 1, the cleaning solution compartment and the cleaning solution reservoir each having a flat shape at the top end of the housing, and a curved shape at the bottom end of the housing.

3. The toilet bowl cleaning apparatus of claim 1, wherein the cleaning solution reservoir is removable from the cleaning solution compartment.

4. The toilet bowl cleaning apparatus of claim 1, wherein the pump tube has a first diameter, and each toilet bowl tube of the plurality of toilet bowl tubes has a second diameter, and wherein the second diameter is smaller than the first diameter.

5. The toilet bowl cleaning apparatus of claim 1, wherein the plurality of toilet bowl tubes is three toilet bowl tubes.

6. A toilet bowl cleaning apparatus for cleaning a toilet bowl of a toilet, the toilet bowl cleaning apparatus comprising:

a housing having:

a top end;

a bottom end;

a left side;

a right side;

a front surface; and a rear surface;

a cleaning solution compartment within the housing, the cleaning solution compartment having:

a cleaning solution reservoir configured to hold liquid;

a valve associated with the cleaning solution reservoir;

a pump compartment within the housing, the pump compartment having:

a reservoir tube extending out from the valve;

a pump connected to the reservoir tube, the pump being configured to dispense the liquid held in the cleaning solution reservoir via the reservoir tube; and a pump tube extending from the pump and out of the housing;

wherein the pump is further configured to dispense the liquid through the pump tube;

a plurality of toilet bowl tubes;

a splitter;

wherein the plurality of toilet bowl tubes is connected to the pump tube via the splitter, such that the liquid is further dispensed from the pump tube to each toilet bowl tube of the plurality of toilet bowl tubes and is sprayed out of the plurality of toilet bowl tubes and into the toilet bowl;

at least one interior wall within the housing, the at least one interior wall separating the cleaning solution compartment and the pump compartment, and wherein the valve extends through the at least one interior wall;

a power source; and an actuator button, wherein the power source is configured to power the pump when the actuator button is engaged.

7. The toilet bowl cleaning apparatus of claim 6, further comprising a plurality of hangers, wherein the plurality of mounting holes is configured to be associated with the plurality of hangers, such that the toilet bowl cleaning apparatus can be hung from a surface.

8. The toilet bowl cleaning apparatus of claim 6, the cleaning solution compartment and the cleaning solution reservoir each having a flat shape at the top end of the housing, and a curved shape at the bottom end of the housing.

9. The toilet bowl cleaning apparatus of claim 6, wherein the cleaning solution reservoir is removable from the cleaning solution compartment.

10. The toilet bowl cleaning apparatus of claim 6, wherein the pump tube has a first diameter, and each toilet bowl tube of the plurality of toilet bowl tubes has a second diameter, and wherein the second diameter is smaller than the first diameter.

11. The toilet bowl cleaning apparatus of claim 6, wherein the plurality of toilet bowl tubes is three toilet bowl tubes.

12. The toilet bowl cleaning apparatus of claim 6, further comprising an air freshener compartment at the front surface of the housing, the air freshener compartment being configured to contain an air freshener cartridge.

13. A method for cleaning a toilet bowl of a toilet, the method comprising the steps of:

receiving a toilet bowl cleaning apparatus, the toilet bowl cleaning apparatus having:

a housing having a top end, a bottom end, a left side, a right side, a front surface, and a rear surface; a cleaning solution compartment within the housing, the cleaning solution compartment having a cleaning solution reservoir configured to hold liquid; a valve associated with the cleaning solution reservoir; a pump compartment within the housing, the pump compartment having a reservoir tube extending out from the valve, a pump connected to the reservoir tube, the pump being configured to dispense the liquid held in the cleaning solution reservoir via the reservoir tube, and a pump tube extending from the pump and out of the housing, wherein the pump is further configured to dispense the liquid through the pump tube; a plurality of toilet bowl tubes; a splitter; wherein the plurality of toilet bowl tubes is connected to the pump tube via the splitter, such that the liquid is further dispensed from the pump tube to each toilet bowl tube of the plurality of toilet bowl tubes and is sprayed out of the plurality of toilet bowl tubes and into the toilet bowl; a plurality of clamps, each clamp of the plurality of clamps being configured to attach a toilet bowl tube of the plurality of toilet bowl tubes to the toilet bowl; a plurality of interior walls within the housing, the plurality of interior walls separating the battery compartment, the cleaning solution compartment, the pump compartment, and the air freshener compartment, and wherein the valve extends through an interior wall of the plurality of interior walls separating the cleaning solution compartment and the pump compartment; a power source; an actuator button, wherein the power source is configured to power the pump when the actuator button is engaged; a plurality of mounting holes on the rear surface; and a plurality of hangers, wherein the plurality of mounting holes is configured to be associated with the plurality of hangers;

inserting the plurality of hangers into the plurality of mounting holes;

hanging the plurality of hangers on a top edge of a toilet tank of the toilet;

securing each toilet bowl tube of the plurality of toilet bowl tubes to an outer rim of the toilet bowl using the plurality of clamps; and engaging the actuator button to spray the liquid into the toilet bowl.

14. The method of claim 13, the toilet bowl cleaning apparatus further comprising an air freshener compartment at the front surface of the housing, the air freshener compartment being configured to contain an air freshener cartridge.

15. The method of claim 13, further comprising the steps of:

determining the further cleaning is needed on the toilet bowl to remove residue on the toilet bowl; and repeating the engaging the actuator button step until the residue is fully removed.

16. The method of claim 13, further comprising the steps of:

determining that the liquid has been depleted from the cleaning solution reservoir; and refilling the cleaning solution reservoir with an additional supply of liquid.

17. The method of claim 13, further comprising the steps of:

determining that the liquid has been depleted from the cleaning solution reservoir;

removing the cleaning solution reservoir from the cleaning solution compartment; and inserting a second cleaning solution reservoir into the cleaning solution compartment, the second cleaning solution reservoir being full with an additional supply of liquid.

18. The method of claim 13, wherein the pump tube has a first diameter, and each toilet bowl tube of the plurality of toilet bowl tubes has a second diameter, and wherein the second diameter is smaller than the first diameter.

19. The method of claim 13, the cleaning solution compartment and the cleaning solution reservoir each having a flat shape at the top end of the housing, and a curved shape at the bottom end of the housing.

20. The method of claim 13, wherein the plurality of toilet bowl tubes is three toilet bowl tubes.

* * * * *